US011120959B2

(12) United States Patent
Selvaggi

(10) Patent No.: US 11,120,959 B2
(45) Date of Patent: Sep. 14, 2021

(54) SYSTEM AND METHOD FOR QUICK AND LOW NOISE RELAY SWITCHING OPERATION

(71) Applicant: tiko Energy Solutions AG, Bern (CH)

(72) Inventor: Yuri Selvaggi, Zürich (CH)

(73) Assignee: TIKO ENERGY SOLUTIONS AG, Bern (CH)

( * ) Notice: Subject to any disclaimer, the term of this patent is extended or adjusted under 35 U.S.C. 154(b) by 0 days.

(21) Appl. No.: 17/261,926

(22) PCT Filed: Mar. 11, 2019

(86) PCT No.: PCT/EP2019/056033
§ 371 (c)(1),
(2) Date: Jan. 21, 2021

(87) PCT Pub. No.: WO2020/035171
PCT Pub. Date: Feb. 20, 2020

(65) Prior Publication Data

US 2021/0249209 A1 Aug. 12, 2021

(30) Foreign Application Priority Data

Aug. 15, 2018 (CH) ..... 00991/18

(51) Int. Cl.
*H01H 47/32* (2006.01)
*H01F 7/18* (2006.01)
*H01H 9/54* (2006.01)

(52) U.S. Cl.
CPC ..... *H01H 47/325* (2013.01); *H01F 7/18* (2013.01); *H01H 9/542* (2013.01); *H01F 2007/1894* (2013.01)

(58) Field of Classification Search
CPC ..... H01H 47/325; H01H 9/542; H01F 7/18; H01F 2007/1894

(Continued)

(56) References Cited

U.S. PATENT DOCUMENTS 6,347,024 B1 * 2/2002 Blain ..... H01H 9/542 361/13
6,560,088 B1 * 5/2003 Beck ..... F01L 9/20 361/154
7,116,541 B2 * 10/2006 Hertz ..... H01H 47/32 361/187

FOREIGN PATENT DOCUMENTS

GB 2284100 A 5/1995

OTHER PUBLICATIONS

International Search Report & Written Opinion in PCT/EP2019/056033 dated Jun. 27, 2019, 13 pages.

* cited by examiner

*Primary Examiner* — Dharti H Patel
(74) *Attorney, Agent, or Firm* — Pearne & Gordon LLP

(57) ABSTRACT

A hybrid relay (1) comprises an electromechanical part (10) with a movable contact (103), a solid state relay (11) and a control unit (2) for applying a drive signal (S',S") to the drivable coil (101) of the electromechanical part. A method for operating the hybrid relay comprises steps of determining a first minimum voltage ($V_1$) for the drive signal above which the movable contact (103) starts to move away from an open position ($P_o$) and a second minimum voltage ($V_2$) for the drive signal above which the movable contact (103) reaches the closed position ($P_c$), and a step of shaping a waveform (W) for the drive signal comprising a portion (W1) consisting of a vertical segment jumping from zero to the first minimum voltage value, a portion (W2) wherein the voltage gradually increases from the first minimum value to the second minimum voltage value, and a portion (W3) consisting of another vertical segment jumping from the second minimum voltage value to an upper voltage boundary ($V_{sup}$).

10 Claims, 4 Drawing Sheets

(58) Field of Classification Search
USPC ..... 361/160
See application file for complete search history.

FIG. 7
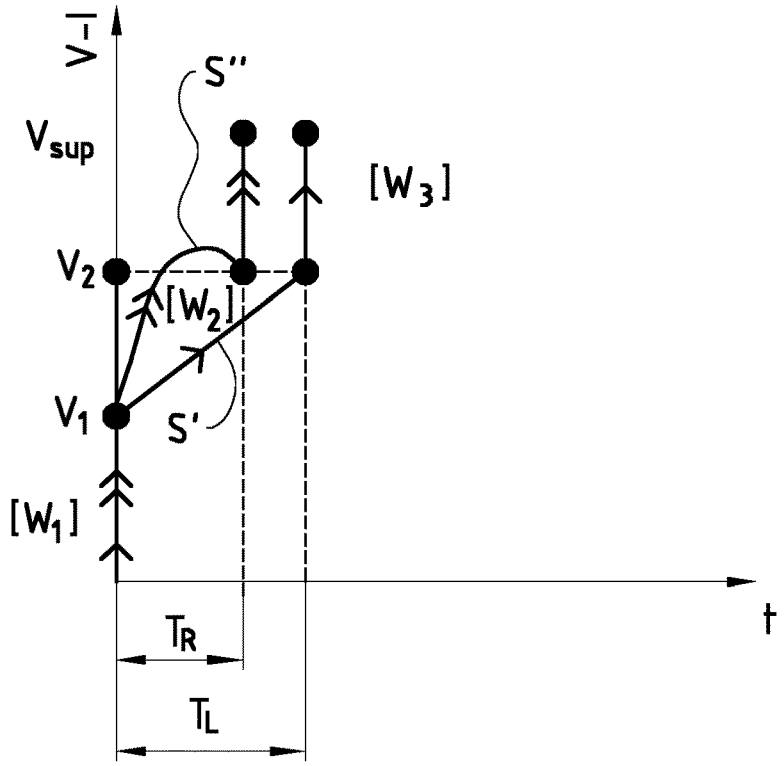
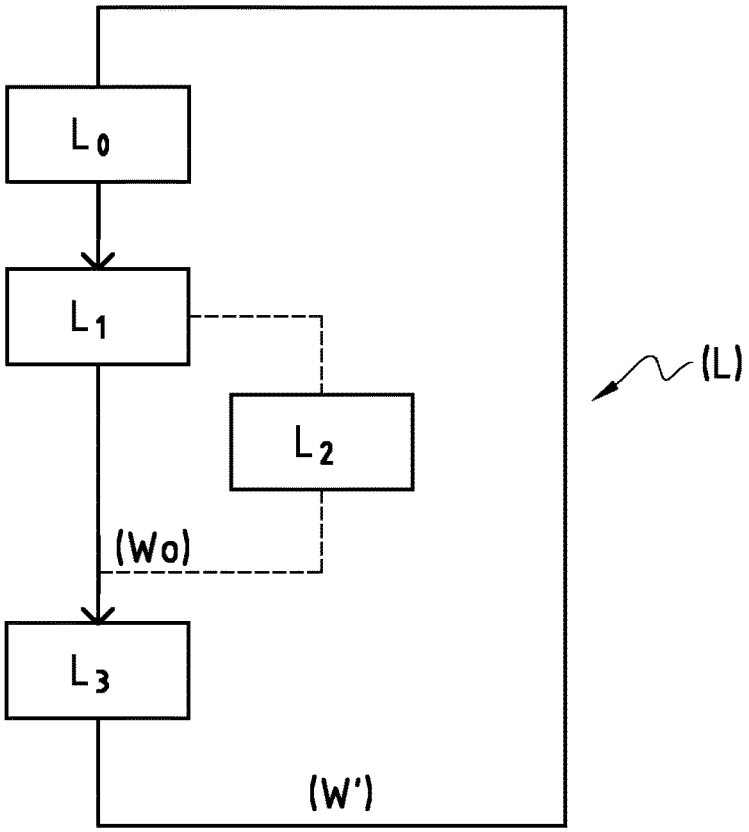
FIG. 8

SYSTEM AND METHOD FOR QUICK AND LOW NOISE RELAY SWITCHING OPERATION

TECHNICAL FIELD

The invention relates to the field of electrical relays, and especially hybrid relays.

BACKGROUND

Switching electrical loads of up to few tens of Amperes (5-20 A for instance) can be performed using two different kinds of relay technologies: electro-mechanical or based on semiconductors. Each of them have pros and cons.

Electro-mechanical relays are acoustically noisy due to the sound produced by the mechanical impact of the metal moving contacts. Usually the higher the power rate, the noisier the relay. Moreover the relay is subject to arcing thus the number of commutations in its lifetime is limited, usually in the order of some $10^4$-50.000 on average. Yet as an advantage, the dissipated energy (electrical and thus thermal) is very small.

In order to reduce the switching noise of such electromechanical relays, U.S. Pat. No. 7,116,541 suggests using a drive unit comprising an optocoupler for applying a supply voltage to a drivable coil, wherein a first minimum value of supply voltage which is sufficient to move the switching contacts, and a second minimum value of supply voltage as of which the switching contacts are into mutual contact, are defined. The supply voltage is linearly increased from the first to the second minimum value. While this solution is supposed to reduce the noise levels by an order of magnitude of 4 (about 6 dB) primarily by avoiding the bouncing the switching contacts against each other, it cannot guarantee that the resulting switching noise is substantially excluded from the audible range; moreover it generates, on the other hand, an irreducible time delay caused by the timer of the drive unit in the form of a capacitor determining the time at which the supply voltage can be increased from the first to the second minimal value.

The second kind of relays, which are made of semiconductors, are so-called Solid State Relays (SSRs). They have the advantage of offering a virtually unlimited number of commutations, and they are completely silent. However, they have a significant thermal dissipation, which reduces the use cases they fit in. To take a simple example, with technology available nowadays, in order to support a standard 16 A contact, a heatsink as big as a 10 inches notebook is required. Moreover, the order of magnitude for the dissipated energy is about 20-25 W for a 16 A load).

Hybrid relays combining electromechanical and TRIAC (standing for triode for alternating current) solid state relay (SSR) features are also known. In such relays, a TRIAC/SSR is used only along the commutation phase of the relay, with the aim of increasing the lifetime thereof. Test performed over hybrid relays have shown that after 10 million switching operations, the device could still work properly and the electrical contacts of the electromechanical relay would still remain intact.

However, while the lifetime of such hybrid relay devices is significantly increased, a problem that still needs to be solved is how to switch them silently, i.e. without almost producing any audible noise.

A first option for addressing this issue is to move the electrical contacts of the relay slower, thus reducing the generated switching noise. The slow movement is achieved by providing a slowly increasing amount of voltage or current to the relay's coil.

A negative side effect of the slower movement of the contacts is that the overall switching operation takes longer. This is not a big issue when switching on the relay, i.e. moving from "OFF" to "ON", because the presence of the TRIAC intended to increase the lifetime will then immediately close the contacts, causing no side effect but the heating thereof, while the relay's contact are slowly traveling. Therefore, the only constraint for the relay to work in such a configuration is that the TRIAC has enough dissipation capability to sustain the current for the time required for the relay's contact to slowly close. The order of magnitude for the slow traveling time considered here ranges within 5 to 10 seconds.

Switching off the relay, i.e. moving from "ON" to "OFF" is more critical in terms of delay because this operation still has to be done while keeping the TRIAC's contacts closed, which means that the TRIAC can only be opened at the very end of the traveling. Thus, if the traveling takes 5 seconds, for instance, there will be a delay of 5 seconds from a nominal or desired switching off time to the actual switching off. There are many applications where such a delay cannot be tolerated or would even cause a safety problem.

In view of the above, there is hence a need for improving the closing speed of such hybrid relays while still keeping them silent.

Furthermore, when a progressive V (voltage) or I (current) ramp is applied as a drive signal S to a relay in order to bring it from its open position $P_o$ to its closed position $P_c$ (see FIG. 1), there is a first time period $t_a$ in a first phase A during which the contacts are not moving followed by a second time period $t_b$ in a second phase B during which the contacts are then indeed moving (see the middle part of FIG. 1, whereby the movement of the contacts is depicted as being piecewise linear for the sake of simplification), and eventually a third time period $t_c$ in a third phase C during which contacts do not move any longer, but pressure increases at the mutual contact level, thereby granting a good low contact resistance. As a result, the overall closing time $T_o$ of the relay is quite inefficient and there is also room for improvement in that respect.

Since relays are typically cheap components—their price ranges from sub dollar to a few dollars—they are manufactured often within imprecise tolerances, so that performance consistency cannot be ensured. Indeed, they are often made of plastic and metal, entailing big tolerances which are reflected in different behaviors from one piece to another even of the same part number coming from the same manufactured batch. This tolerance creates a positional shift of the starting time at which the relay contacts begin to move versus the same drive signal S applied, as shown in FIG. 2A and FIG. 2B representing graphically two relays having supposedly nominally equal characteristics, but showing different behaviors. The first relay R1 depicted in FIG. 2A has a shorter first time period $t_{a1}$ than the first time period $t_{a2}$ of the second relay R2 depicted in FIG. 2B, so that the second phase B starts sooner, while the second time period $t_b$ during which the contacts are moving is identical for both, as well as the third time period $t_c$. Thus a time shift $\Delta t$ is highlighted between the starts of each second time periods $t_b$ for the first and the second relays R1 and R2, respectively.

Thus in order to support this variability, a longer time period is required to silently switch all relays.

As a result, there is also a need for new types of relays and related switching operations taking these different behaviors into account.

SUMMARY

An object of the present invention is to provide an enhanced relay having a long lasting operational time, while strongly reducing acoustic noise and performing the switching operation in the shortest possible time.

Another object of the present invention is to further improve the switching-time efficiency of silent hybrid relays, and also to cope with the performance variability of their electromechanical parts.

To this end, the present invention concerns a method for operating a hybrid relay below a predefined low noise level, i.e. basically below levels detectable by human ears, comprising a solid state relay part and electromechanical part mounted in parallel, wherein the electromechanical part has a drivable coil, at least a first stationary contact, and at least movable contact that can be alternatively switched between a closed position and an open position, wherein a control unit is connected to the drivable coil via a digital-to-analog converter for applying in operation a drive signal to said drivable coil, the method comprising:

A first step of determining a first minimum voltage value for the drive signal above which said movable contact starts to move away from the open position;

A second step of determining a second minimum voltage value for the drive signal above which the movable contact reaches the closed position ($P_c$);

And a subsequent step of shaping a waveform for a modified drive signal comprising a first portion consisting of a substantially vertical segment jumping from zero to the first minimum voltage value yielded in the previous first step; followed by second portion, wherein the voltage is gradually increased from the first minimum value to the second minimum voltage value yielded in the previous second step within a time period shorter or equal to a noise-free linear closing time representative of a closing time achievable by applying either actually or theoretically a linear drive signal having a predefined slope in order to remain below the predefined low noise level constraints set for the hybrid relay, and finally a third portion consisting of another substantially vertical segment jumping from said second minimum voltage value to an upper voltage boundary applicable to the drivable coil.

A "substantially vertical segment" is herein understood as a segment during which the voltage is increased/decreased as fast as possible given the components of the drive circuit. Thus the duration of these segments is made as short as possible with the operational boundaries of the device. A waveform is understood to describe the drive signal as a function of time. An advantage conferred by the claimed solution is that it significantly reduces the overall closing time of the relay by removing idle times when the movable contact is not moving, while still driving the relay smoothly enough so that the noise levels generated are not affected and still remain within an acceptable level range.

According to a preferred embodiment, the linear drive signal stretches over a first segment during a first phase when said movable contact is not moving and the relay is in the open position, then a second segment during a second phase during which the movable contact is moving, and then a third segment during a third phase during which the movable contact has arrived in mutual contact with a stationary switching contact and the closed position is reached, and wherein the second portion of the waveform of the modified drive signal corresponds to the second segment of the linear drive signal.

An advantage conferred by the preferred embodiment is that it is very simple to implement by leveraging previously obtained first minimum and the second minimum voltage value for establishing the noise-free linear closing time.

According to another preferred embodiment, the second portion of the waveform of a further modified drive signal is non-linear, and preferably gradually increases the voltage from the first minimum value to the second minimum voltage value yielded in the previous first and second steps within a reduced time period strictly inferior to the noise-free linear closing time.

An advantage conferred by the preferred embodiment is that it defines other shapes of curves, such a logarithmic-shaped curves, that can be designed to compensate for the acceleration pattern of the moving contact, which in turn may be characterized as being inversely proportional of the square of the spacing between the armatures. By using such improved curve shapes, as opposed to a linear shape of the driving signal used when obtaining the noise-free linear closing time, it is possible to move the switching contact smoothly enough so as to not generate too much speed when reaching the contact point, while further reducing the closing time of the relay.

According to yet another preferred embodiment, the first minimum voltage value and the second minimum voltage are relay-specific. In this case, the voltage difference between the first minimum voltage value and the second minimum voltage values defines wave shapes which are also specific to each relay, and as a result the closing time is not only reduced, but optimized for each relay.

According to yet another preferred embodiment, the first step of determining the first minimum voltage value and the second step of determining the second minimum voltage value are carried out during a characterisation step of the relays, preferably during their manufacturing. This helps streamline the overall calculation process.

According to a variant of this preferred embodiment, this characterisation step yields a first minimum voltage values and a second minimum voltage for a whole batch of relays, so that a global optimization is carried out taking performance variability into account.

According to yet another preferred embodiment, the hybrid relay further comprises an acoustical sensor allowing for automatic detection of the first minimum voltage and second minimum voltage yielded in the previous first and second steps after performing a collecting step of noise data during relay operation.

An advantage conferred by this preferred embodiment is that the characterization step described above can be omitted; moreover, adjustment would be automatically provided in case of a relay change, and performance optimization is always guaranteed since it is always possible to provide optimal device-specific values in this case.

According to a preferred variant for this preferred embodiment, a default waveform is first defined in a subsequent step following the collecting step, and an ongoing step of adjusting the waveform to an improved waveform is then performed in a closed feedback loop after analysing further noise data along the operational lifetime of the hybrid relay.

An advantage conferred by this preferred variant embodiment is that the computation of the closing time of the relay is a self-adapted to the wearing and/or the aging of the relay. As a result, it is always ensured that the lowest possible switching time is obtained.

The present invention otherwise also relates to a hybrid relay comprising a control unit suitable for implementing the method previously described, as well as a hybrid relay further comprising an acoustical sensor in order to carry out the preferred embodiment for the present invention involving an auto-learning algorithm for the calculation of optimized closing times.

BRIEF DESCRIPTION OF THE DRAWINGS

The following figures introduced previously and belonging to the prior art illustrate.

For FIG. 1: the three phase behaviour of the contacts of a relay supplied by a linear drive signal, when switching the relay from its open position to its closed position.

For FIG. 2A and respectively

Figure 3:
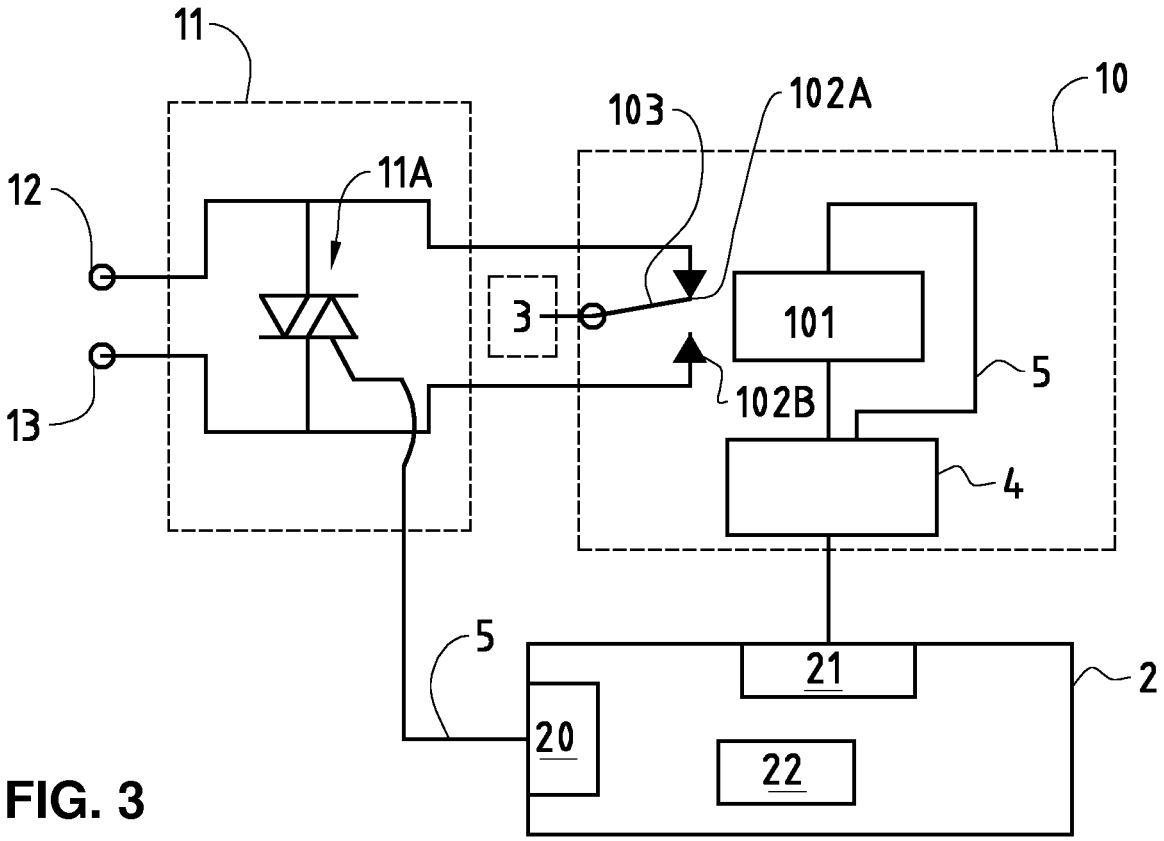
Figure 4:
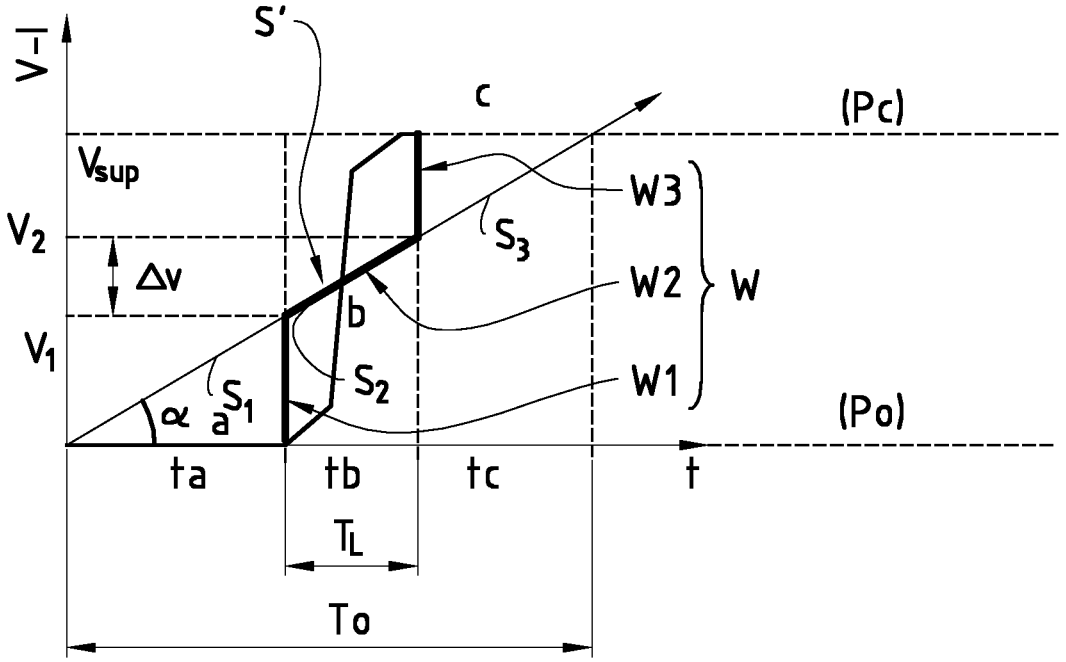
Figure 5:
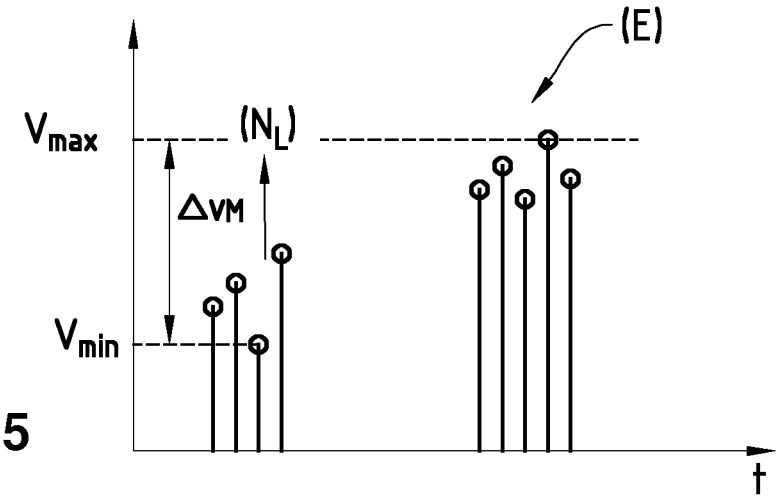
Figure 6:
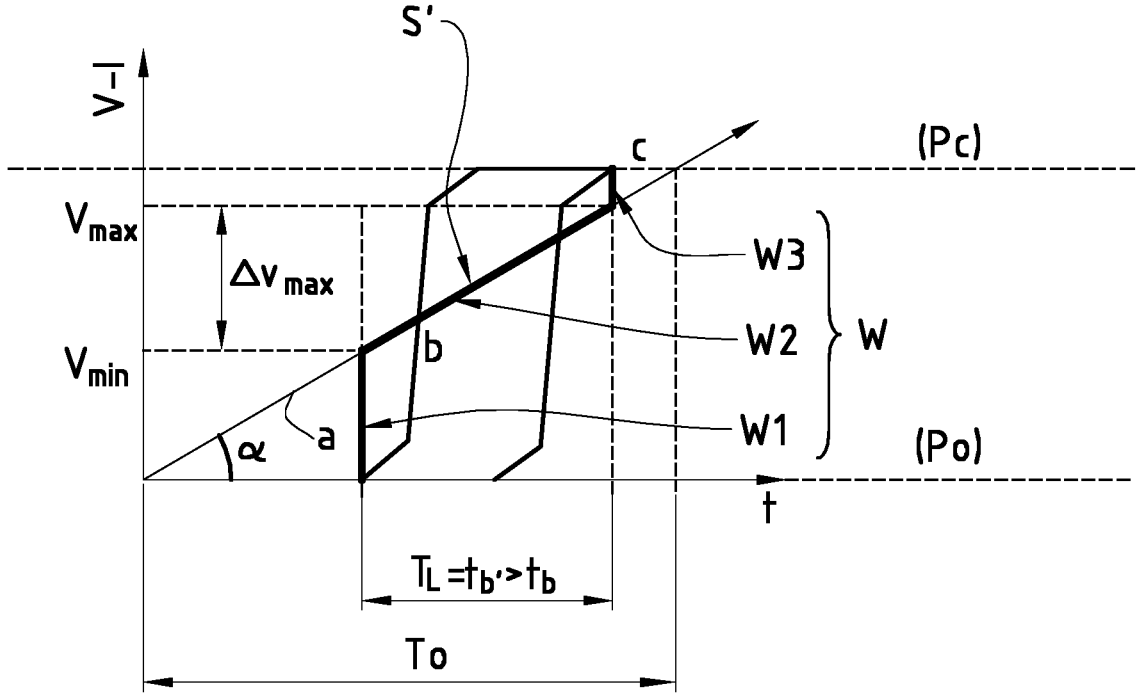

The invention will now be described in greater detail with reference to accompanying figures, in which:

FIG. 3 shows schematically the structural components of a hybrid relay used in the framework of the present invention, and well as the control unit attached to it, and an acoustical sensor according to a preferred embodiment for the present invention;

FIG. 4 shows a modified drive signal according to a preferred embodiment for the present invention in order to shorten the overall closing time;

FIG. 5 shows an exemplary characterization step in order to determine boundary voltages for the beginning and end of the second phase when contacts start and stop moving;

FIG. 6 shows another modified drive signal according to a further preferred embodiment for the present invention, taking into account a wider range of different possible switching behaviours for the relay.

FIG. 7 shows a further modified drive signal according to yet another preferred embodiment for the present invention, wherein the waveform of the further modified signal is non-linear.

FIG. 8 shows schematically a self-learning algorithm that may be applied to a hybrid relay comprising an acoustical sensor according to yet another preferred embodiment for the present invention.

DETAILED DESCRIPTION

In the following, preferred methods and a system according to a preferred embodiment for the present invention will be described. These exemplary embodiments are given by way of example only, and shall not be construed in a limiting manner. While describing figures, references that have already been introduced and are redundant with previously discussed figures will be omitted.

The method used in the framework of the present invention uses a combination of electro-mechanical and solid state relay, also known as hybrid relay, in order to increase the total number of switches, and to switch the relay while strongly reducing acoustic noise and performing the switching in the shortest possible time by shaping new types of waveforms to drive the relay's coil.

A preferred system for applying the disclosed method is depicted in FIG. 3, showing a hybrid relay 1 made of an electromechanical part 10, and a solid state relay (SSR) part 11 comprising a TRIAC 11A. The electromechanical relay's contacts, i.e. the first contact 12 and the second contact 13, are connected in parallel to the SSR's contacts, here the first stationary switching contact 102A and the second stationary switching contact 102B, thus each of these two components can close the circuit and drive the load to be controlled. A control unit 2 comprising a central processing unit 22 is connected on the one hand to the SSR part 11 through a connection wire 5 via a TRIAC driver interface 20, and on the other hand to the electromechanical part 12 through another connection wire 5 via a relay driver interface 21 that produces drive signals via a digital-to-analog converter 4 driving the drivable coil 101 to smoothly drive the moving contact 103 of the electromechanical relay with an optimized switching speed. Next to the moving contact 103 is illustrated a noise detector 3, which helps implement a preferred method for the present invention involving a self-learning algorithm, described later.

In order to maximize the number of total switches/commutations, i.e. improving the lifetime of the hybrid relay 1, the following procedure shall be used to close the hybrid relay 1:

1. The SSR contacts are closed
2. The mechanical Relay contacts are closed
3. The SSR contacts are opened While the contacts are kept closed by the SSR, the current (both inrush and normal) will go through the SSR, generating thermal dissipation.

No arc will be produced on the contacts of the electromechanical relay part 10 as most of the current will go through the SSR part 11. A small amount of energy will still go through the mechanical relay due to the voltage drop of the SSR's junction. This represents typically less than 1% of the overall load (in typical main line 230V operations).

Once the commutation of the electromechanical relay is completed, the SSR are opened and the load will go through the electromechanical relay only.

The procedure to open the contact is:

1. The SSR contacts are closed
2. The mechanical Relay contacts are opened
3. The SSR contacts are opened Comparative laboratory tests have shown that after 50.000 commutations at about 70% resistive load on a 16 A relay, the contacts of a system steered by the electromechanical relay only are at close to their end of life; in contrast, when using such a hybrid relay 1, the contacts are still very similar to their state at the beginning of operation, even after 10 million switches at full load (16 A).

In the following, further details are provided as to how the mechanical mobile contact 103 can be switched silently. Although the electromechanical part 10 of the relay illustrated in FIG. 3 contains two stationary contacts, it can be appreciated that only one such contact is necessary to perform the switching operation.

The goal during this step is to achieve a movement of the moving contact 103 of the electromechanical part 10 of the relay as smooth as possible, i.e. not entering into mutual contact with the stationary contact at a speed that would be too high and generate too much sound. To reach this goal, the drivable coil 101 of the hybrid relay 1 is driven with a progressive increasing/decreasing voltage or current (depending if contact has to be closed/opened). During the commutation time, the load is handled by the SSR part 11 thus not affecting the electromechanical relay endurance. Without the coverage of the SSR part 11 it would not be possible to slowly move the moving contact 103 because the prolonged arcing due to slow movement would then destroy the contacts very quickly.

Figure 1:
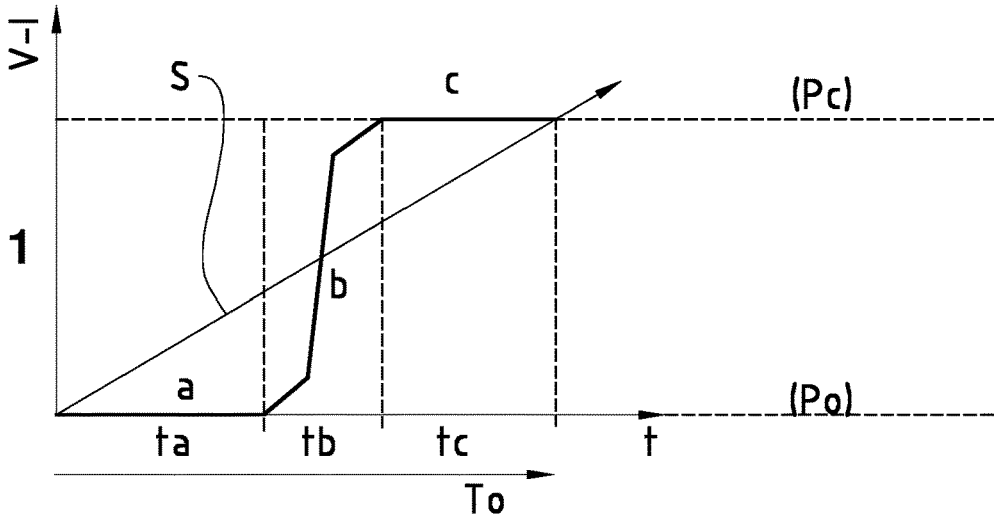
Figure 2A:
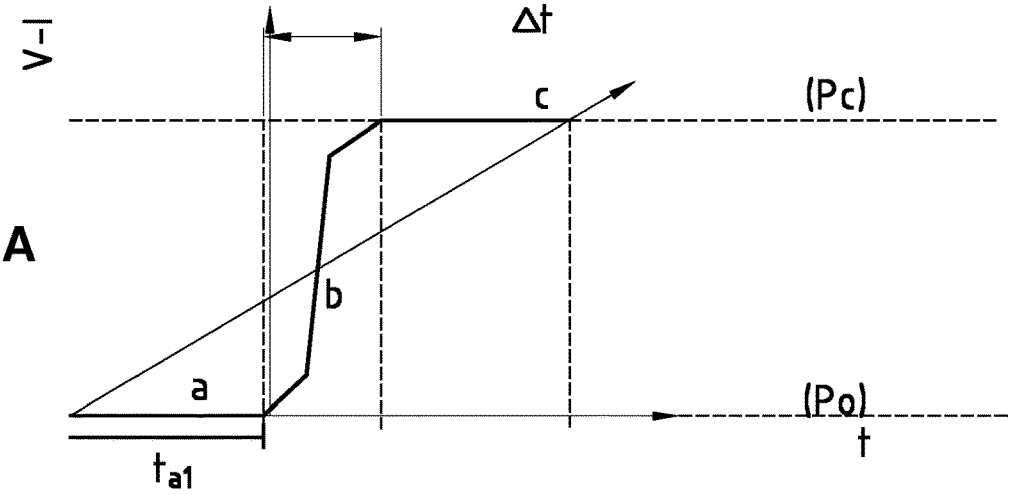
FIG. 2B: a comparison of the behaviour of two distinct relays when switched from their open position to their closed position, highlighting a time shift between the starts of the second phase when the contacts start moving for each of the relays.
Figure 2B:
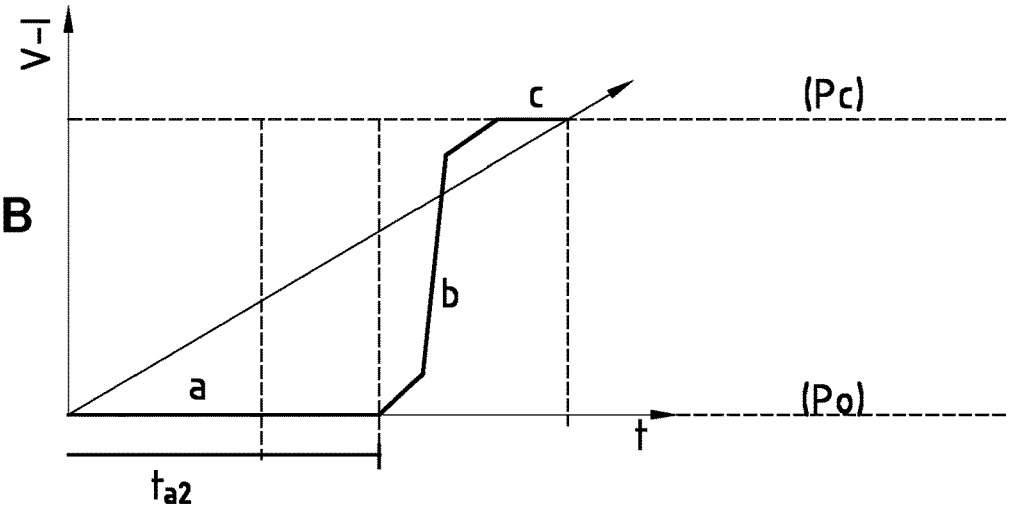

Based on predefined noise levels NL, that can be typically set to the lower boundary of audible range, a progressive linear drive signal S just like the one illustrated previously in FIG. 1 can be derived, whose slope $\alpha$ defines a so-called noise-free linear closing time TL, i.e. the time that would be needed to carry out the second phase B, i.e. the phase during which the moving contact 103 is actually moving, lasting for the second time period $t_b$ (see FIG. 4).

FIG. 4 actually shows a linear drive signal increasing linearly the voltage during a closing phase of the hybrid relay 1 having a slope a that can be split into three parts:

- A first segment S1 lasting a first time period $t_a$ in the first phase A during which the contacts are not moving;
- A second segment S2 lasting a second time period $t_b$, corresponding to the second phase B during which the contacts are then moving and eventually
- A third segment S3 lasting a third time period $t_c$ in a third phase C during which contacts do not move any longer, but pressure increases at the mutual contact level until the voltage reaches upper voltage boundary $V_{sup}$ applicable to the drivable coil 101.

The combination of all linear segments S1,S2,S3 is a continuous linear waveform similar to the one of the linear drive signal S known in the prior art, (illustrated in FIG. 1), now with a slope $\alpha$.

According to the present invention, the switching of the hybrid relay 1 is obtained by still remaining below the predefined noise levels NL, but by defining a new waveform W for the arbitrary curve of V/I (Voltage or Current), i.e. the drive signal, in order to spare the time where the ramp-up of the V/I doesn't produce any movement, materialized by the first time period $t_a$ and the third time period which are phases during which no movement occurs.

According to the preferred embodiment illustrated on FIG. 4, the waveform W of the modified drive signal S' to drive the drivable coil 101 shows:

- A sudden jump to the area where movement starts, i.e. basically moving instantly within the operational capacities of the drive circuit from zero to a first voltage minimum voltage value V1 reached by the linear drive signal S after at the end of the first phase A (i.e. after a first time period $t_a$ has lapsed). This is indicated by the first substantially vertical portion W1;
- A soft ramp which is linear and corresponds to the second segment (S2) of the linear drive signal (S) in the second phase B, which is shown as the second portion W2;
- A final sudden jump to put pressure to the contacts in order to grant a good contact, moving instantly from a second minimum voltage value linear noise-free closing time $T_L$ as indicated by the third substantially vertical portion W3.

This way, thanks to the new yielded waveform W of the modified drive signal S', the overall closing time $T_o$ of the relay is brought down to close to $t_b$, which is equal to the noise-free linear closing time TL. As a result, both $t_a$ and $t_c$ are significantly reduced since the first phase A and the third phase C are shortened to close to zero.

According to a preferred embodiment, the first minimum voltage value and the second minimum voltage value are yielded by a preliminary so-called characterization step E during which it is checked from which voltage or current level onwards noise can be detected due to the movement of the contact, and from which voltage or current level onwards this noise stops after moving contact the stationary contact is reached.

FIG. 5 shows an exemplary characterization step E carried out for a whole batch of relay devices, thus yielding a lower minimum voltage value $V_{min}$ corresponding to the minimum value for which any of the relays start making noise (i.e. when the threshold of the predefined noise levels NL is detected, here for the third bar starting from the left, each bar corresponding to one of the relays of the batch), as well as a higher minimum voltage value $V_{max}$ corresponding to the maximum value as of which all of the relays stop making noise (i.e. when the threshold of the predefined noise levels NL is no more detected, here for the first bar starting from the right, each bar also corresponding to one of the relays of the batch). As a result, a maximum voltage gap $\Delta V_M$ is defined, which is greater than the regular voltage gap $\Delta V$ between the second minimum voltage $V_2$ and the first minimum voltage $V_1$ of any single relay.

In order to take the performance variability into account, FIG. 6 shows a diagram employing a similar solution for shaping the shape of the waveform W of a modified drive signal S', still anticipating the first time period $t_a$ of the first phase A and skipping the third time period $t_b$ of the third phase A. The overall closing time $T_o$ of the relay is brought down to another second time period $t_b'$, which is however slightly longer than the second time period $t_b$ obtained for a single relay device. This is due to the fact that the slope $\alpha$ of the drive signals S remains the same in order to comply with the predefined noise level $N_L$ constraints, while there is now a greater voltage gap $\Delta V_M > V$.

In this way the system is able to accommodate the different behavior of different hybrid relays 1 provided, or more specifically of the electromechanical part 10 thereof. However, since the closing time is somewhat longer than in the case of a single hybrid relay ($t_{b'} > t_b$, as illustrated on FIG. 6) a more complex shape for the modified waveform W of the drive signal S, yielding a further modified drive signal S", is introduced as a variant of the present invention. This variant allows to find a good trade-off between reduced time achievement and performance variability support.

This waveform W is designed so as to still comply with the predefined noise level $N_L$ constraints, but intends to minimize the overall closing time $T_o$ to a further reduced closing time $T_R$ that would be strictly shorter than the linear noise-free closing time $T_L$ defined previously, i.e. to a closing time essentially reduced to the second time period $t_b$ or to slightly extended second time period $t_{b'}$ for a batch of devices.

FIG. 7 explains how this waveform W works using the case of a single hybrid relay 1 for which the first minimum voltage $V_1$ and second minimum voltage $V_2$ have been defined. It can be appreciated though that the same waveform would apply to a batch of relays by using for example the lowest minimum voltage value $V_{min}$ and the highest minimum voltage value $V_{max}$ of the batch. Just like in the previous case illustrated in FIG. 4, the waveform comprises a first substantially vertical portion W1, which is the same as the one applied to the modified drive signal S'; however, the second portion W2 is no more linear, but e.g. logarithmic as shown, in order to better compensate for the acceleration of the moving contact 103 when is it driven by the coil. Thus the W2 portion of the further modified drive signal S" stops before the W2 portion of the modified drive signal S' using a linear segment only, and it reaches the second minimum voltage $V_2$ after a reduced closing time $T_R$ instead of the linear noise-free closing time $T_L$. Then, third substantially vertical portion W3 corresponding to the final sudden jump of increasing the voltage from the second minimum voltage $V_2$ to the upper voltage boundary $V_{sup}$ is applicable to the drivable coil 101 for both the modified drive signal S' and the further modified drive signal S" and merely shifted by a time difference $T_L-T_R$. The waveform corresponding to the modified drive signal S' is indicated by a single arrow, whereas the waveform corresponding to the further modifier drive signal S" is indicated by a double arrow in order to better visualize their common and distinct portions or respectively segments.

In order to progressively control the voltage or current driving the drivable coil 101, preferably a small microcontroller acting a central processing unit 22 plus a digital to analog converter 4 are used to synthesize the controlled ramp up (voltage/current for the coil) corresponding to the modified drive signal S' and the further modified drive signal S". This way a very precise control can be performed; the waveform W of the ramp can be stored in the memory of the microcontroller, and/or in an external memory and can be remotely updated in case of need for changes after device deployment. The possibility to remotely update can be helpful in case of a wrong characterization of the waveform W or in case of unexpected change of the relay behavior due to specific wearing or aging. A remote update can swap the old waveform with a new waveform.

Another preferred embodiment for the present invention uses an acoustic sensor 3 (like a microphone), as shown previously on FIG. 3, or a vibration sensor (like a piezo-crystal) onto the electromechanical part 10 of the hybrid relay 1. This sensor can be used to collect the noise produced by the electro-mechanical part 10 of the relay, and then perform a closed feedback loop in order to auto-learn the position of the each of the first phase A, second phase B, and third phase C of the relay depicted in previous FIG. 4.

The main advantages of having such a closed-loop auto-learning algorithm are:

- No characterization step is required beforehand, i.e. at manufacturing stage, which can be quite complex and time consuming. And also occurrences of a wrong characterization can be avoided.
- No external or remote adaptation is necessary in case of relay type change;
- Significant gains can be achieved in terms of operational speed: indeed, the opening and closing time are always shortened in an optimized way, because it is always possible to operate like in the diagram of FIG. 4 instead of the diagram of FIG. 6. Since the values yielded are device specific, they are always better that when stemming from batches;
- And another key advantage of this preferred embodiment is the self-adaptation to wearing and/or aging of the relay while always keeping the lowest possible switching time;

A basic flow-chart for a preferred implementation of the "self-learning" solution proposed in the framework of the present invention is shown in FIG. 8, where the closed loop L defines a first step $L_0$ of operating the relay, and then another step of collecting noise data $L_1$ for an automatic detection of the first minimum voltage $V_1$ and second minimum voltage $V_2$ can be performed.

The "self-learning algorithm" can be implemented in many different ways. One out of many can be via successive approximation for a first determination of the waveform W and further improvement loops are only performed if and when noise is sensed. Or, alternatively a periodical retuning can be performed in order to guarantee always the best performance during long period of times, in case wearing/aging modify the characteristics of the relay. The "periodical retuning" can be triggered either by time elapsed or by number of commutations performed.

FIG. 8 shows an example of such periodical fine-tuning. In a first iteration, a default waveform $W_0$ is defined in a subsequent step $L_2$ following the collecting step $L_1$, and then the waveform W is adjusted to an improved waveform W' after analysing further noise data along the operational lifetime of said hybrid relay in an ongoing step $L_3$.

By using the hybrid relay 1 and the method for operating such a relay as explained in the above description, noise level reduction up to 18 dB have been reported, which goes far beyond the usual reduction levels that were achieved so far (more than ten times better in terms of attenuation).

Apart from the above without departing from the scope of the gist of the present invention, it is possible to replace components of the above-described embodiments by other well-known components as appropriate. Further, the above-described modifications may be combined with each other as appropriate. For example, other shapes than the logarithmic shape for the second portion W2 of the waveform could also be considered, as long as they provide time reduction versus the linear case by efficiently compensating for the acceleration of moving contact.

The invention claimed is:

1. Method for operating a hybrid relay below a predefined low noise level comprising a solid state relay part and electromechanical part mounted in parallel, wherein said electromechanical part has a drivable coil, at least a first stationary contact, and at least movable contact that can be alternatively switched between a closed position and an open position, wherein a control unit is connected to said drivable coil via a digital-to-analog converter for applying in operation a drive signal to said drivable coil, the method comprising:

- a first step of determining a first minimum voltage value for said drive signal above which said movable contact starts to move away from said open position;
- a second step of determining a second minimum voltage value for said drive signal above which said movable contact reaches said closed position;
- and a subsequent step of shaping a waveform for a modified drive signal comprising a first portion consisting of a substantially vertical segment jumping from zero to said first minimum voltage value yielded previously in said first step; followed by a second portion, wherein the voltage is gradually increased from said first minimum voltage value to said second minimum voltage value yielded previously in said second step within a time period shorter or equal to a noise-free linear closing time representative of a closing time achievable by applying either actually or theoretically a linear drive signal having a predefined slope ($\alpha$) in order to remain below said predefined low noise level constraints set for said hybrid relay, and finally a third portion comprising another substantially vertical segment jumping from said second minimum voltage value to an upper voltage boundary applicable to said drivable coil.

2. Method for operating a hybrid relay below a predefined low noise level according to claim 1, wherein said linear drive signal stretches over a first segment during a first phase when said movable contact is not moving and the relay is in the open position, then a second segment during a second phase during which said movable contact is moving, and then a third segment during a third phase during which the movable contact has arrived in mutual contact with a stationary switching contact and the closed position is reached, and wherein said second portion of the waveform of the modified drive signal corresponds to said second segment of said linear drive signal.

3. Method for operating a hybrid relay below a predefined low noise level according to claim 1, wherein said second portion of the waveform of a further modified drive signal is non-linear, and gradually increases the voltage value from said first minimum value to said second minimum voltage value yielded previously in said first and second steps within a reduced time period strictly shorter than said noise-free linear closing time.

4. Method for operating a hybrid relay below a predefined low noise level according to claim 1, wherein said first minimum voltage value and said second minimum voltage are relay-specific.

5. Method for operating a hybrid relay below a predefined low noise level according to claim 1, wherein said first step and second step are carried out during a characterisation step of relays.

6. Method for operating a hybrid relay below a predefined low noise level according to claim 5, wherein the characterisation step yields said first minimum voltage value and said second minimum voltage for a whole batch of relays.

7. Method for operating a hybrid relay below a predefined low noise level according to claim 1, wherein said hybrid relay further comprises an acoustical sensor, allowing for automatic detection of the first minimum voltage and second minimum voltage yielded in the previous first and second steps after performing a collecting step of noise data during relay operation.

8. Method for operating a hybrid relay below a predefined low noise level according to claim 7, wherein a default waveform is first defined in a subsequent step following said collecting step, wherein an ongoing step of adjusting the waveform to an improved waveform is then performed in a closed loop after analysing further noise data along the operational lifetime of said hybrid relay.

9. Hybrid relay comprising a control unit suitable for implementing the method according to claim 1.

10. Hybrid relay according to claim 9, further comprising an acoustical sensor.

* * * * *